US005972180A

United States Patent [19]

Chujo

[11] Patent Number: 5,972,180

[45] Date of Patent: Oct. 26, 1999

[54] APPARATUS FOR ELECTROPOLISHING OF HELIX USED FOR A MICROWAVE TUBE

[75] Inventor: Seiji Chujo, Tokyo, Japan

[73] Assignee: NEC Corporation, Tokyo, Japan

[21] Appl. No.: 09/005,590

[22] Filed: Jan. 12, 1998

[30] Foreign Application Priority Data

Jan. 16, 1997 [JP] Japan ..... 9-005369

[51] Int. Cl.[6] ..... C25F 7/00

[52] U.S. Cl. ..... 204/224 M; 204/241; 204/272; 204/273; 204/274

[58] Field of Search ..... 204/224 M, 212, 204/241, 273, 274, 272; 205/686

[56] References Cited

U.S. PATENT DOCUMENTS 638,917 12/1899 Emerson ..... 204/212 X
4,434,039 2/1984 Baboian et al. et al. ..... 204/280 X
5,112,438 5/1992 Bowers ..... 205/118 X

FOREIGN PATENT DOCUMENTS 49-25449 3/1974 Japan .
49-121745 11/1974 Japan .
5-261625 10/1993 Japan .

*Primary Examiner*—Donald R. Valentine
*Attorney, Agent, or Firm*—Young & Thompson

[57] ABSTRACT

An apparatus for electopolishing a helix used for a traveling wave tube has the following structure. A bath is provided which receives an electrolyte solution for etching the helix. A holder is further provided for holding the helix in the electrolyte solution without any displacement or any vibration, wherein a part of the helix is electrically connected to an anode. A controller mechanically supporting a cathode is provided for moving the cathode around the helix at substantially a constant speed in a direction substantially parallel to a longitudinal direction of the helix so as to keep a distance of the cathode from the helix to be substantially constant.

24 Claims, 3 Drawing Sheets

APPARATUS FOR ELECTROPOLISHING OF HELIX USED FOR A MICROWAVE TUBE

BACKGROUND OF THE INVENTION

The present invention relates to an apparatus for electropolishing of a helix for a microwave tube, and more particularly to an apparatus for a uniform electropolishing of a helix for a precision microwave tube which is weak to vibration.

Traveling wave tubes are used in the field of microwave communication networks such as communication satellite broadcast. FIG. 1 is a cross sectional view illustrative of a conventional traveling wave tube The conventional traveling wave tube has a cylindrically shaped body accommodating a helix 6 which comprises a metal tape in the form of helix spirally extending along a longitudinal direction of the cylindrically shaped body. The helix 6 is terminated at input and output portions 41 and 42. The cylindrically shaped body of the conventional traveling wave tube has an emitter side which accommodates an electron gun 42 which emits an electron beam. The cylindrically shaped body of the conventional traveling wave tube also has a collector side which has a collector 45 so that the electron beam emitted from the electron gun 43 travels through the inside of the helix 6 to the collector 45. The helix 6 is applied with a radio frequency current. Actually, a majority part of the radio frequency current or the high frequency current flows in the surface region of the helix 6. The radio frequency current has an interaction with the electron beam 44 whereby the high frequency current is amplified and fetched from the output portion 42. The above helix 6 may be made of a metal such as molybdenum and tungsten. The helix 6 serves as a delay circuit of the traveling wave tube, for which reason the helix 6 is an important element which determines characteristics of the traveling wave tube. It is extremely important that the helix 6 has a precise pitch, a high cleanliness level and accurate dimensions or sizes. An efficiency of the traveling wave tube depends upon the smoothness of surface of the helix 6, for which reason the surface of the helix 6 is required to have a high smoothness. The helix 6 is smoothed by electropolishing thereof.

The helix 6 is then subjected to the electropolishing. FIG. 2 is a schematic view illustrative of a conventional apparatus for electropolishing of the helix of the traveling wave tube. The conventional electropolishing apparatus has an electropolishing bath 5 which is cylindrically shaped and filled with an electrolyte solution 4. The electropolishing bath 5 has a cathode 12 which is so cylindrically shaped as to have a co-axis with the cylindrically shaped electropolishing bath 5. The cathode 12 may comprise a metal plate in the form of cylinder such as stainless. The electropolishing bath 5 has a cathode which is also immersed into the electrolyte solution 4. The helix 6 is immersed into the electrolyte solution 4 and also positioned to extend along a longitudinal direction of the cylindrically shaped electropolishing bath 5. The helix 6 is electrically connected to an anode. A current of a few amperes is applied across the anode connected to the helix 6 and the cathode 12 for carrying out the electropolishing of the helix 6.

Conventional methods for the electropolishing of the helix are disclosed in the Japanese laid-open patent publications Nos. 7-159113 and 56-123400. FIG. 3 is a diagram illustrative of a structure of an electropolishing apparatus disclosed in the Japanese laid-open patent publication No. 56-123400. A sample 50 to be polished is fed by a pair of a feeder roll 52 and a roll 61 into an electropolishing bath 55 for further feeding by rolls 62 and 63 through the electrolyte solution in the electropolishing bath 55 and subsequent pick up by a pair of a feeder roll 53 and a roll 64. The sample 50 is subjected to the electropolishing during the feeding through the electrolyte solution in the electropolishing bath 55. A cathode 51 is provided in the electropolishing bath 55 so that the cathode 51 is immersed into the electrolyte solution and the cathode 51 faces to the sample 50 extending between the rolls 62 and 63. Currents are supplied via the feeding rolls 52 and 53 through the sample 50 and the electrolyte solution to the cathode 51. Namely, the current is applied between the sample 50 and the cathode 51 through the electrolyte solution for electropolishing of the sample 50. When the sample 50 is subjected to the electropolishing during the feeding of the sample 50 between the rolls 6 and 63, then the sample 50 is positioned closer to the cathode 51. In the above conventional electropolishing apparatus, the sample 50 to be electropolished is moved in the electrolyte solution 54.

The above conventional electropolishing apparatuses shown in FIGS. 2 and 3, however, have the following problems. The conventional electropolishing apparatus shown in FIG. 2 has a problem in variation in etching amount by which the helix is etched. The helix 6 has a helical structure of not less than 100 millimeters in length and a resistance of about 0.1 Ω cm, for which reason even if a constant current is applied, then a voltage drop appears thereby causing a variation in etching amount by which the helix is etched, for example, about 20 micrometers in thickness. In this case, it is no longer possible to use the helix electropolished by the above conventional electropolishing apparatus shown in FIG. 2.

On the other hand the movement of the helix causes disturbance in pitch of the helix. Since, however, the pitch of the helix provides a remarkably large influence to the characteristics of the traveling wave tube. A slight vibration of the helix may cause a disturbance in pitch of the helix whereby the yield of the helix is dropped.

In the above circumstances, it had been required to develop a novel apparatus for electropolishing to a helix used for a traveling wave tube free from the above problems.

SUMMARY OF THE INVENTION

Accordingly, it is an object of the present invention to provide a novel apparatus for electropolishing to a helix used for a traveling wave tube free from the above problems.

It is a further object of the present invention to provide a novel apparatus for electropolishing to a helix used for a traveling wave tube, wherein the apparatus is capable of a uniform electropolishing free of any variation in etching amount by which the helix is etched.

It is a still further object of the present invention to provide a novel apparatus for electropolishing to a helix with an accurate pitch and a smooth surface used for a traveling wave tube.

The above and other objects, features and advantages of the present invention will be apparent from the following descriptions.

In accordance with the present invention, an apparatus for electropolishing to a helix used for a traveling wave tube has the following structure. A bath is provided which receives an electrolyte solution for etching the helix. A holder is further provided for holding the helix in the electrolyte solution without any displacement or any vibration, wherein a part of the helix is electrically connected to an anode. A controller mechanically supporting a cathode is provided for moving the cathode around the helix at substantially a constant speed in a direction substantially parallel to a longitudinal direction of the helix so as to keep a distance of the cathode from the helix to be substantially constant. As a result, a uniform electropolishing can be obtained, which is free of any variation in etching amount by which the helix is etched. Since the helix is fixed in position during the electropolishing thereto, then the electropolished helix has an accurate pitch without any substantial disturbance. The electropolished helix also has a smooth surface used for a traveling wave tube.

BRIEF DESCRIPTION OF THE DRAWINGS

Preferred embodiments according to the present invention will be described in detail with reference to the accompanying drawings.

DISCLOSURE OF THE INVENTION

Figure 1:
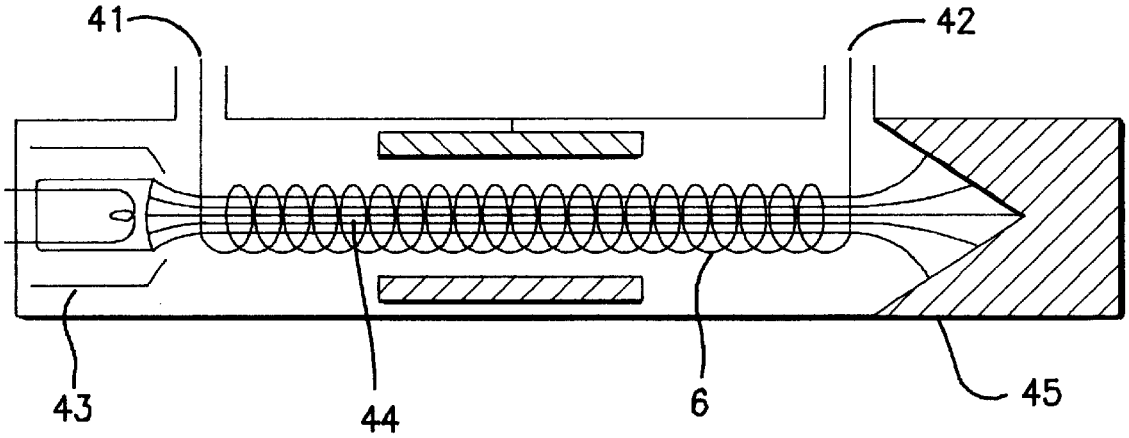
FIG. 1 PRIOR ART
FIG. 1 is a cross sectional view illustrative of the traveling wave tube having a helix.
Figure 3:
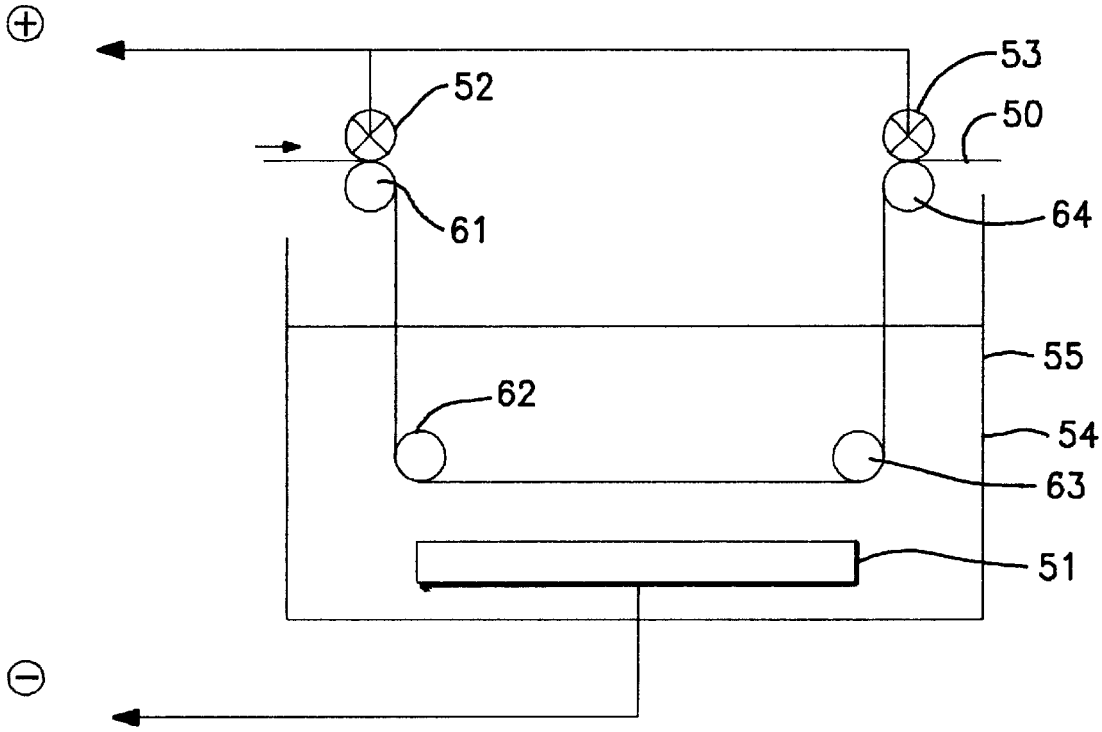
FIG. 3 PRIOR ART
FIG. 3 is a diagram illustrative of a structure of the other conventional electropolishing apparatus for electropolishing of the helix of the traveling wave tube.
Figure 2:
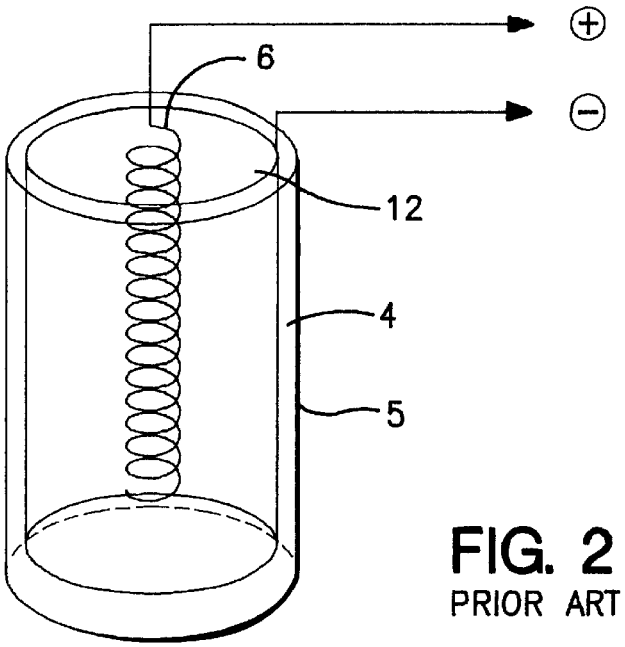
FIG. 2 PRIOR ART
FIG. 2 is a schematic view illustrative of the conventional apparatus for electropolishing of the helix of the traveling wave tube

The present invention provides an apparatus for electropolishing a helix used for a traveling wave tube. A bath is provided which receives an electrolyte solution for etching the helix. A holder is filer provided for holding the helix in the electrolyte solution without any displacement or any vibration, wherein a part of the helix is electrically connected to an anode. A controller mechanically supporting a cathode is provided for moving the cathode around the helix at substantially a constant speed in a direction substantially parallel to a longitudinal direction of the helix so as to keep a distance of the cathode from the helix to be substantially constant. As a result, a uniform electropolishing can be obtained, which is free of any variation in etching amount by which the helix is etched. Since the helix is fixed in position during the electropolishing thereto, then the electropolished helix has an accurate pitch without any substantial disturbance. The electropolished helix also has a smooth surface used for a traveling wave tube.

It is preferable that the cathode has a looped structure and the cathode is so positioned that the helix is positioned at a center of the cathode for uniform and isotropic electropolishing.

It is also preferable that the looped structure is a ring and the cathode is so positioned that the helix is positioned at a center of the cathode for uniform and isotropic electropolishing.

It is also preferable that the cathode has a semi-looped structure partially opened and the cathode is so positioned that the helix is positioned at a center of the cathode for allowing the helix to be set at the center through the opening of the cathode.

It is also preferable that the looped structure is a semi-ring partially opened and the cathode is so positioned that the helix is positioned at a center of the cathode for allowing the helix to be set at the center through the opening of the cathode.

It is also preferable that the holder holds opposite ends of the helix which extends in an elevational direction to prevent any formation of the free end of tie helix so as to avoid any displacement and vibration of the helix.

It is also preferable that the holder is made of an electrically conductive material which is insoluble to the electrolyte solution for preventing variation in component of the electrolyte solution so that the holder is applied with an anode voltage.

It is also preferable that the controller is operable to control a speed of the cathode in accordance with a computer program to set the conditions of the electropolishing by the computer program.

It is also preferable to further provide a temperature controller for controlling the electrolyte solution at a constant temperature for realizing the uniform electropolishing. In this case, the constant temperature may be in the range of 40–50° C.

It is also preferable to further provide a stirrer in the bath for stirring the electrolyte solution to avoid variation in concentration of the electrolyte solution over position for realizing the uniform electropolishing.

It is also preferable that a distance of the cathode from the helix is kept about 1 centimeter.

PREFERRED EMBODIMENTS

Figure 4:
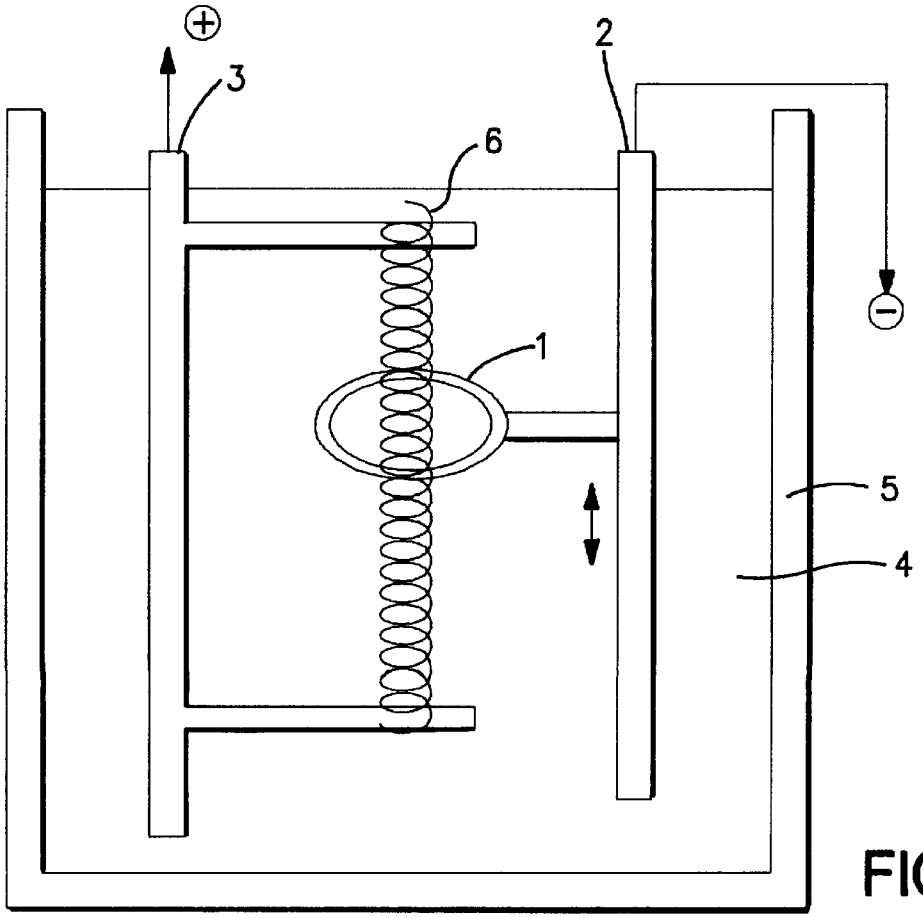
FIG. 4 is a schematic view illustrative of a novel apparatus for electropolishing to a helix of the traveling wave tube in accordance with the present invention.
Figure 5:
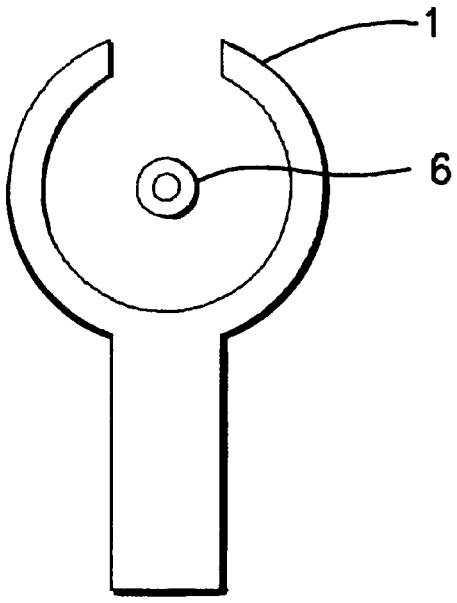
FIG. 5 is a schematic view illustrative of a cathode of a first type used in a novel apparatus for electropolishing to a helix of the traveling wave tube in accordance with the present invention.

First Embodiment:

A first embodiment according to the present invention will be described in detail with reference to FIGS. 4 and 5, wherein an apparatus for electropolishing to a helix used for a traveling wave tube is provided. An electropolishing bath 5 is provided for pooling an electrolyte solution 4 for etching the helix. A helix holder 3 is also provided which comprises a straight body extending in a vertical or elevational direction and two arms extending in a direction perpendicular to a longitudinal direction of the straight body so that the helix 6 is held at its opposite ends by the top portions of the two arms of the helix holder 3. The helix holder 3 is so set that the two arms are immersed in the electrolyte solution 4 in the electropolishing bath 5 whereby the helix 6 is also immersed in the electrolyte solution 4. The helix 6 has a helical structure of 1.5 millimeters in outer diameter and 200 millimeters in length. The helix 6 is made of molybdenum. The electrolyte solution 4 comprises a 20%-sulfuric acid solution. The helix holder 3 this made of an electrically conductive material but insoluble to the electrolyte solution 4 so that the electrolyte solution 4 serves as an anode. A controller 2 is provided which supports and positions a cathode 1 which is looped so that the helix 6 is positioned at a center of the looped cathode 1. As illustrated in FIG. 5, the cathode 1 may be shaped in semi-ring with an opening portion. The cathode 1 is made of stainless. The controller 2 is capable of moving the cathode in a vertical direction which is in parallel to the longitudinal direction of the helix 6 at a moving distance of about 10 centimeters. The controller 2 is also operable by a computer program to control a speed of the cathode 1, preferably at a constant speed in the range of about 10 centimeters per a minute to 50 centimeters per a minute. The cathode 1 is preferably shaped in ring of 5 millimeters in inner diameter. For the electropolishing, a current of 14 A is applied between the helix 6 and the cathode 1. The electropolished helix 6 is released from the helix holder 3 without applying a vibration to the helix 6 in order to avoid variation in pitch of the helix 6. The electropolished helix 6 is then cleaned with chromium sulfuric acid for subsequent dry process of the helix.

A variation in thickness by which the helix 6 had been etched in the electroplating was not more than about 5 micrometers. Substantially no variation in pitch of the electropolished helix 6 was observed. A measured maximum roughness of surface of the electropolished helix was reduced from 6 micrometers to not more than 2 micrometers.

Figure 6:
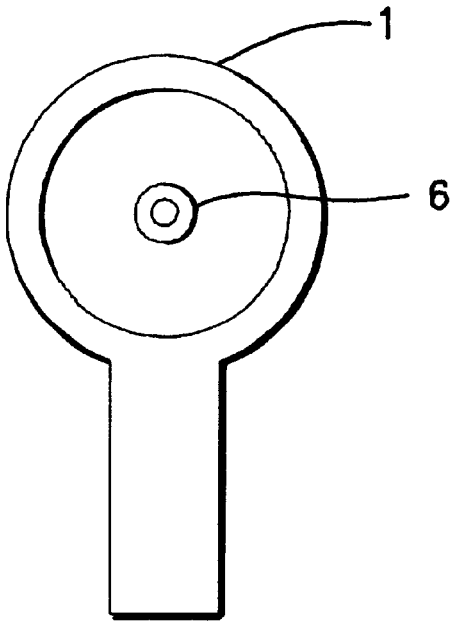
FIG. 6 is a schematic view illustrative of another cathode of a second type used in a novel apparatus for electropolishing to a helix of the traveling wave tube in accordance with the present invention.

Second Embodiment:

A second embodiment according to the p resent invention will be described in detail with reference to FIGS. 4 and 6, wherein an apparatus for electropolishing to a helix used for a traveling wave tube is provided. A difference in structure of the apparatus in this embodiment from that in the first embodiment is only the shape of the cathode. An electropolishing bath 5 is provided for pooling an electrolyte solution 4 for etching the helix. A helix holder 3 is also provided which comprises a straight body extending in a vertical or elevational direction and two arms extending in a direction perpendicular to a longitudinal direction of the straight body so that the helix 6 is held at its opposite ends by the top portions of the two arms of the helix holder 3. The helix holder 3 is so set that the two arms are immersed in the electrolyte solution 4 in the electropolishing bath 5 whereby the helix 6 is also immersed in the electrolyte solution 4. The helix 6 has a helical structure of 1.5 millimeters in outer diameter and 200 millimeters in length. The helix 6 is made of molybdenum The electrolyte solution 4 comprises a 20%-sulfuric acid solution. The helix holder 3 is made of an electrically conductive material but insoluble to the electrolyte solution 4 so that the electrolyte solution 4 serves as an anode. A controller 2 is provided which supports and positions a cathode 1 which is looped so that the helix 6 is positioned at a center of the looped cathode 1. As illustrated in FIG. 6, the cathode 1 may be shaped in complete ring. The cathode 1 is made of stainless. The controller 2 is capable of moving the cathode in a vertical direction which is in parallel to the longitudinal direction of the helix 6 at a moving distance of about 10 centimeters. The controller 2 is also operable by a computer program to control a speed of the cathode 1, preferably at a constant speed in the range of about 10 centimeters per a minute to 50 centimeters per a minute. The cathode 1 is preferably shaped in ring of 5 millimeters in inner diameter. For the electropolishing, a current of 14 A is applied between the helix 6 and the cathode 1. The electropolished helix 6 is released from the helix holder 3 without applying a vibration to the helix 6 in order to avoid variation in pitch of the helix 6. The electropolished helix 6 is then cleaned with chromium sulfuric acid for subsequent dry process of the helix.

A variation in thickness by which the helix 6 had been etched in the electroplating was not more than about 2 micrometers. Substantially no variation in pitch of the electropolished helix 6 was observed. A measured maximum roughness of surface of the electropolished helix was reduced from 6 micrometers to not more than 2 micrometers.

Whereas modifications of the present invention will be apparent to a person having ordinary skill in the art, to which the invention pertains, it is to be understood that embodiments as shown and described by way of illustrations are by no means intended to be considered in a limiting sense.

Accordingly, it is to be intended to cover by claims all modifications which fall within the spirit and scope of the present invention.

What is claimed is:

1. An apparatus for electropolishing a helix used for a traveling wave tube, comprising:

a container adapted to hold an electrolyte solution used for etching the helix;

means for holding the helix in the electrolyte solution without any displacement or any vibration, wherein a part of the helix is electrically connected to a first electrode; and means mechanically connected with a second electrode for moving said second electrode around the helix.

2. The apparatus as claimed in claim 1, wherein said means for moving said second electrode is operated to move said second electrode at substantially a constant speed in a direction substantially parallel to a longitudinal direction of the helix so as to keep a distance of said second electrode from the helix substantially constant.

3. The apparatus as claimed in claim 1, wherein said first electrode is an anode and said second electrode is a cathode.

4. The apparatus as claimed in claim 1, wherein said second electrode has a looped structure and said second electrode is so positioned that the helix is adapted to be positioned at a center of said second electrode.

5. The apparatus as claimed in claim 4, wherein said looped structure is a ring and the second electrode is so positioned that said helix is adapted to be positioned at a center of said second electrode.

6. The apparatus as claimed in claim 1, wherein said second electrode has a semi-looped structure partially opened and said second electrode is so positioned that the helix is adapted to be positioned at a center of said second electrode.

7. The apparatus as claimed in claim 6, wherein said looped structure is a semi-ring line partially opened and said second electrode is so positioned that the helix is adapted to be positioned at a center of said second electrode.

8. The apparatus as claimed in claim 1, wherein said means for holding the helix holds opposite ends of the helix which extends in an elevational direction.

9. The apparatus as claimed in claim 1, wherein said means for holding the helix is made of an electrically conductive material which is insoluble to the electrolyte solution for preventing variation in component of said electrolyte solution.

10. The apparatus as claimed in claim 1, wherein said means for moving said second electrode is operable to control a speed of said second electrode in accordance with a computer program.

11. The apparatus as claimed in claim 1, further comprising a temperature controller for controlling said electrolyte solution at a constant temperature.

12. The apparatus as claimed in claim 11, wherein said temperature controller is adapted to maintain the electrolyte solution at a constant temperature in the range of 40–50°C.

13. The apparatus as claimed in claim 11, further comprising a stirrer provided in said container for stirring the electrolyte solution to avoid variation in temperature of the electrolyte solution over position.

14. An apparatus for electropolishing a helix used for a traveling wave tube, comprising:

a bath receiving an electrolyte solution for the helix;

a holder for holding the helix in the electrolyte solution without any displacement or any vibration, wherein a part of the helix is electrically connected to an anode; and a controller mechanically supporting a cathode for moving said cathode around the helix at substantially a constant speed in a direction substantially parallel to a longitudinal direction of the helix so as to keep a distance of said cathode from the helix substantially constant.

15. The apparatus as claimed in claim 14, wherein said cathode has a looped structure and said cathode is so positioned that the helix is adapted to be positioned at a center of said cathode.

16. The apparatus as claimed in claim 15, wherein said looped structure is a ring and the cathode is so positioned that said helix is adapted to be positioned at a center of said cathode.

17. The apparatus as claimed in claim 14, wherein said cathode has a semi-looped structure partially opened and said cathode is so positioned that the helix is adapted to be positioned at a center of said cathode.

18. The apparatus as claimed in claim 17, wherein said looped structure is a semi-ring line partially opened and said cathode is so positioned that the helix is positioned at a center of said cathode.

19. The apparatus as claimed in claim 14, wherein said holder holds opposite ends of the helix which extends in an elevational direction.

20. The apparatus as claimed in claim 14, wherein said holder, is made of an electrically conductive material which is insoluble to the electrolyte solution for preventing variation in component of the electrolyte solution when said holder is applied with an anode voltage.

21. The apparatus as claimed in claim 14, wherein said controller is operable to control a speed of said cathode in accordance with a computer program.

22. The apparatus as claimed in claim 14, further comprising a temperature controller for controlling the electrolyte solution at a constant temperature.

23. The apparatus as claimed in claim 22, wherein said temperature controller is adapted to maintain the electrolyte solution at a constant temperature in the range of 40–50° C.

24. The apparatus as claimed in claim 14, further comprising a stirrer provided in said bath for stirring said electrolyte solution to avoid variation in temperature of the electrolyte solution over position.

* * * * *